United States Patent [19]

Tsumiyama

[11] Patent Number: 4,615,313

[45] Date of Patent: Oct. 7, 1986

[54] AUTOMATIC DECOMPRESSION DEVICE FOR INTERNAL COMBUSTION ENGINE

[75] Inventor: Yoshinori Tsumiyama, Akashi, Japan

[73] Assignee: Kawasaki Jukogyo Kabushiki Kaisha, Kobe, Japan

[21] Appl. No.: 637,566

[22] Filed: Aug. 3, 1984

[30] Foreign Application Priority Data

Aug. 10, 1983 [JP] Japan ..... 58-124978[U]

[51] Int. Cl.[4] ..... F01L 13/08

[52] U.S. Cl. ..... 123/182; 123/90.16; 123/90.17; 123/420

[58] Field of Search ..... 123/182, 90.16, 420, 123/90.17

[56] References Cited

U.S. PATENT DOCUMENTS 3,511,219 5/1970 Esty ..... 123/182
3,620,203 11/1971 Harkness ..... 123/182
3,897,768 8/1975 Thiel ..... 123/182
3,901,199 8/1975 Smith ..... 123/182
4,338,893 7/1982 Pomfret et al. ..... 123/90.16

FOREIGN PATENT DOCUMENTS 0020486 5/1981 Japan .
0023894 of 1913 United Kingdom ..... 123/182

*Primary Examiner*—Parshotam S. Lall
*Attorney, Agent, or Firm*—Leydig, Voit & Mayer, Ltd.

[57] ABSTRACT

A decompression device for facilitating startup of an internal combustion engine including a member formed with an auxiliary cam operative to decompress a cylinder in a compression stroke when the engine is in a low engine speed range. The member is supported by a stopper pin secured to the member in a position substantially symmetrical with the auxiliary cam with respect to the axis of camshaft. The auxiliary cam is of a cylindrical pillar shape.

4 Claims, 12 Drawing Figures

AUTOMATIC DECOMPRESSION DEVICE FOR INTERNAL COMBUSTION ENGINE

FIELD OF THE INVENTION

This invention relates to an automatic decompression device for an internal combustion engine, particularly a four-cycle internal combustion engine of the type having suction valves and exhaust valves, which device is capable of avoiding the production of a high compression pressure in the cylinder and reducing torque and power required for starting the engine.

DESCRIPTION OF THE PRIOR ART

Figure 1:
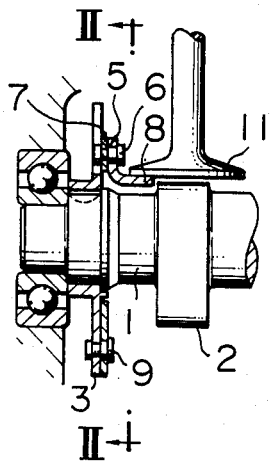
FIG. 1 PRIOR ART
FIG. 1 is a side view of an automatic decompression device of the prior art.
Figure 2:
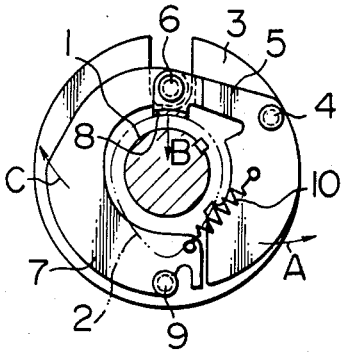
FIG. 2 PRIOR ART
FIG. 2 is a sectional view taken along the II—II line in FIG. 1.

A proposal has been made by us to use an automatic decompression device of the type described as shown in FIGS. 1 and 2, which is disclosed in Japanese Utility Model Publication No. 20486/81. As shown, the device comprises a holder 3 including a cylindrical boss portion fitted around a camshaft 1 and secured thereto in a position adjacent a cam 2 on the camshaft 1, a first centrifugal weight 5 pivotably connected to the holder 3 through a first pin 4, and a second centrifugal weight 7 pivotably connected to the first centrifugal weight 5 through a second pin 6. The first centrifugal weight 5 has a cam portion 8 located in the vicinity of the second pin 6, and the holder 3 has a stopper pin 9 abutting against one end of the second centrifugal weight 7. Spring 10 is mounted between the first and second centrifugal weights 5 and 7. When the engine is in a low engine speed range prior to startup or immediately after startup, the first and second centrifugal weights 5 and 7 are moved to the positions shown in FIG. 2 by the biasing force of the spring 10, with the cam portion 8 being out of the contour (phantom line) of the cam 2 and abutting against a tappet 11 in a compression stroke of the engine, to press same and open a valve to release the air from a combustion chamber to avoid a rise in pressure. After the engine speed has risen to a sufficiently high level, the first and second centrifugal weights 5 and 7 are displaced against the biasing force of the spring 10 in such a manner that their centers of gravity shift outwardly, so that the cam portion 8 moves to a position inside the contour of the cam 2. When in this position, the cam portion 8 is out of engagement with the tappet 11 and allows the engine to operate normally in a compression stroke.

At engine startup at which the cam portion 8 is rendered operative, the force applied to the cam portion 8 by the tappet 11 is finally transmitted largely to the holder 3 through the stopper pin 9 secured thereto. While being finally transmitted as aforesaid, the force is transmitted through the pivot of the second pin 6, and a portion of the force is transmitted through the first centrifugal weight 5 directly to the first pin 4 as well. Thus, as the cam portion 8 is repeatedly brought into abutting engagement with the tappet 11, the second pin 6 pivotably supporting the second centrifugal weight 7 on the first centrifugal weight 5 and the first pin 4 supporting the first centrifugal weight 5 might become wobbly, causing a lift of the tappet 11 brought about by the cam portion 8 to become indefinite. Further, the cam portion 8 is in the form of a square claw as shown. The cam portion 8 of this configuration raises the problem that the cam portion 8 might abruptly lift the tappet 11 and cause mechanical noises to be produced.

SUMMARY OF THE INVENTION

(1) OBJECT OF THE INVENTION

This invention has as its object the provision of an automatic decompression device capable of smoothly lifting a valve operating member, such as a tappet, to prevent the production of mechanical noises, and to prevent the wear of parts that might be caused by wobbling, to keep the lift constant.

(2) STATEMENT OF THE INVENTION

To accomplish the aforesaid object, the invention provides a decompression device for an internal combustion engine comprising a holder, an engine speed-responsive mechanism, a cam structure, and a tension spring assembly. The holder is secured to a camshaft which supports cams having a contour for controlling suction and exhaust valves of the engine. A first cylindrical pin and a stopper pin are secured to the holder. The engine speed-responsive mechanism includes a first centrifugal weight supported by the holder for pivotal movement about the first cylindrical pin and a second centrifugal weight supported on the first centrifugal weight for pivotal movement about a second pin havng an axis parallel to the camshaft. The second centrifugal weight has first and second recesses disposed in positions substantially symmetrical with the second pin with respect to the center axis of the camshaft for engagement with the stopper pin. The cam structure includes a cylindrical pillar disposed on the second centrifugal weight radially inwardly of the second pin. The cam structure extends axially of the camshaft toward the cams for engagement with a valve-operating member associated with one of the cams. The tension spring assembly is mounted between the first centrifugal weight and the second centrifugal weight for moving the weights between a first position and a second position. In the first position at high engine speeds when the first and second centrifugal weights are displaced by centrifugal forces, the second recess of the second centrifugal weight engages the stopper pin and the cylindrical pillar of the cam structure is disposed radially within the contour of the one cam to disengage from the associated valve-operating member and permit normal engine operation. In the second position at low engine speeds or when the engine is stopped, the first recess of the second cylindrical weight engages the stopper pin and the cylindrical pillar of the cam structure is disposed radially outside of the contour of the one cam to engage and lift the associated valve-operating member to a decompression position.

Other and further objects, features and advantages of the invention will appear more fully from the following description.

DETAILED DESCRIPTION OF THE PREFERRED EMBODIMENT

The invention will now be described as being applied to a motorcycle engine shown in the accompanying drawings.

Figure 3:
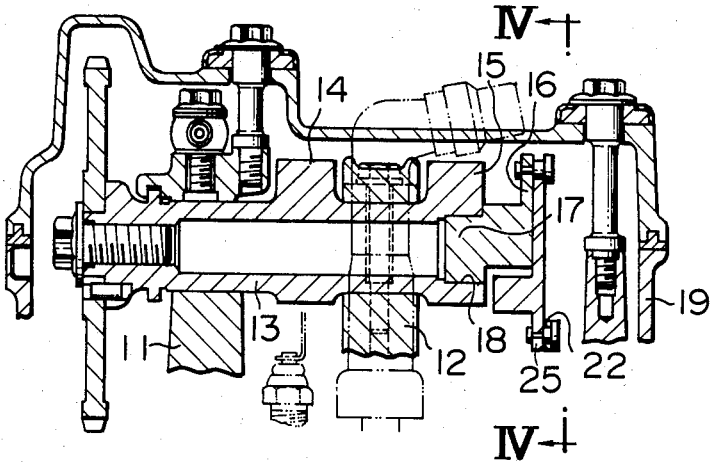
FIG. 3 is a vertical sectional fragmentary view of a motorcycle engine incorporating the present invention therein.
Figure 9:
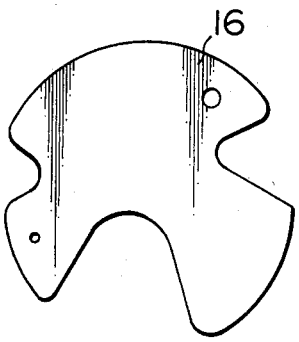
FIGS. 9, 10 and 11 are views of a holder, a first centrifugal weight and a second centrifugal weight respectively.
Figure 10:
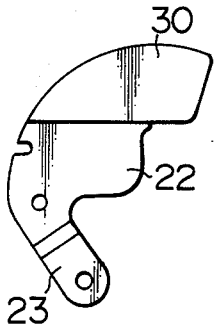
Figure 11:
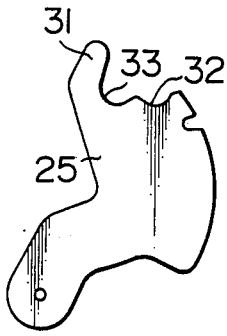

Referring to FIG. 3 which is a vertical sectional view of the engine, a pair of bearings 11 and 12 journal a camshaft 13 of a relatively small diameter within a cylinder head 19. The camshaft 13 has cams 14 and 15 opposed to tappets, not shown in FIG. 3, respectively. The automatic decompression device is supported at one end face of the camshaft 13 and comprises a holder 16, a first centrifugal weight 22 and a second centrifugal weight 25 which are configured as shown in FIGS. 9, 10 and 11 respectively so that they can be housed in a small space and yet move in smooth relative movements while producing adequate centrifugal forces. The holder 16 is substantially discal in shape and formed integrally with a pillar-like projection 17 which is force fitted in a major diameter portion 18 of the camshaft 13 so as to be concentrically connected with a projecting end of the camshaft 13.

Figure 4:
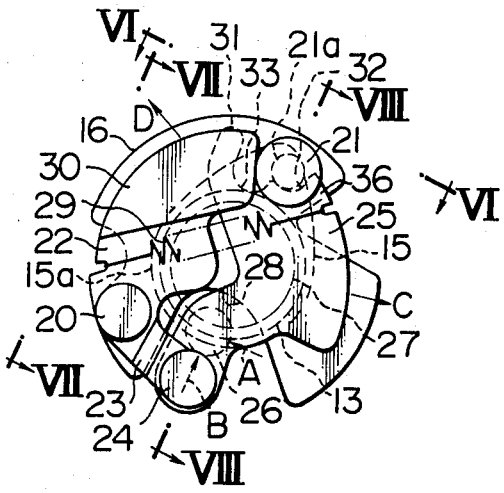
FIG. 4 is an enlarged view of the motorcycle engine shown in FIG. 3, as viewed in the direction of arrows IV.
Figure 5:
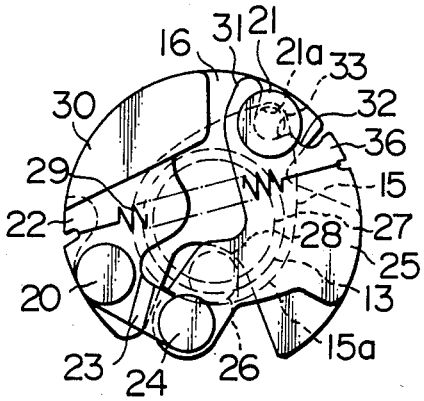
FIG. 5 is a view of the motorcycle engine corresponding to FIG. 4 but showing the engine in a condition after startup.
Figure 7:
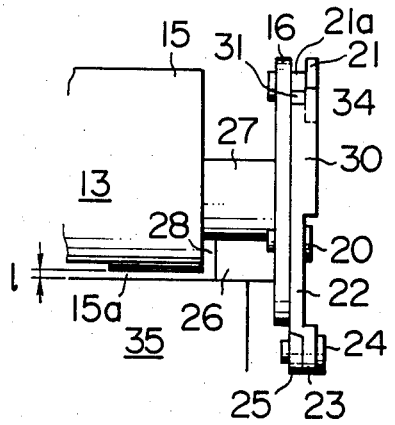
Figure 8:
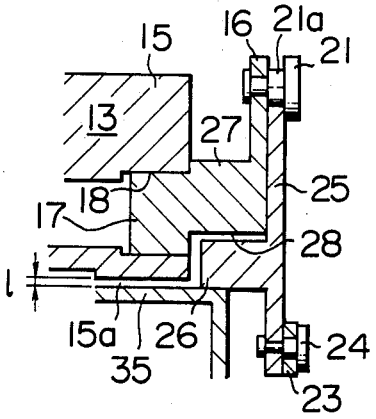
FIG. 8 is a sectional view taken along the VIII—VIII line in FIG. 4.

Referring to FIG. 4, a first pin 20 and a stopper pin 21 are secured to the holder 16 in positions substantially diametrically opposed to each other. The first centrifugal weight 22 is pivotably supported by the first pin 20 on the holder 16. The first centrifugal weight 22 includes an arm portion 23 integral therewith and located in staggered relation to a main body of the first centrifugal weight 22 while projecting rightwardly in FIG. 7, to which one end of the second centrifugal weight 25 is pivotably connected by a second pin 24. A cam portion (decompression cam) 26 of a cylindrical pillar shape, either formed integrally with the second centrifugal weight 25 or secured thereto to provide a unitary structure, is located on the second centrifugal weight 25 in the vicinity of the second pin 24 and extends parallel to the camshaft 13 toward the cam 15. The cam portion 26 is disposed in a recess 28 formed in the projection 17, as shown in FIG. 8, and displaced by about 180 degrees in phase from the vertex of the cam 15 in such a manner that, as subsequently to be described, when the engine is in a low engine speed range at startup, the cam portion 26 projects radially outwardly from a base surface 15*a* of the cam 15 a small distance (corresponding to the decompression stroke l).

Figure 6:
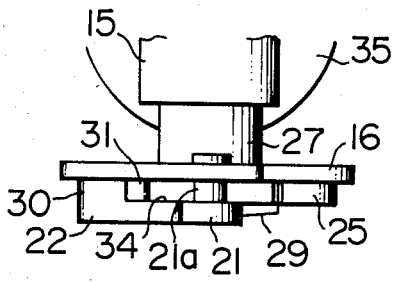
FIGS. 6 and 7 are views of the engine as viewed in the directions of arrows VI and VII in FIG. 4 respectively.

Referring to FIG. 4, a spring 29 is mounted between the centrifugal weights 22 and 25. The first centrifugal weight 22 has an increased thickness portion 30 which is urged against the stopper pin 21 by the spring 29. The second centrifugal weight 25 is formed, at an end portion thereof opposite the one end thereof at which it is pivotably connected to the first centrifugal weight 22, with a radially extending projection 31 and first and second recesses 32 and 33 located adjacent the projection 31. Prior to engine startup, the first recess 32 has a minor diameter portion 21*a* of the stopper pin 21 engaged therein. The projection 31 is received in a recess 34 formed in the increased thickness portion 30 (FIG. 6), and the two centrifugal weights 22 and 25 are partially in overlapping relation. A tappet 35 corresponding to the cam 15 is connected to one exhaust valve or suction valve, not shown.

In operation, prior to startup or during the superlow speed operation of the engine at startup, the biasing force of the spring 29 is higher than centrifugal forces of the two centrifugal weights 22 and 25, so that the two centrifugal weights 22 and 25 are located in relative positions shown in FIG. 4, and the cam portion 26 is disposed in the position in which it projects radially outwardly from the cam base surface 15*a* as described hereinabove. While the camshaft 13 makes one complete revolution counterclockwise in FIG. 3, the cam portion 26 is brought into abutting engagement with the tappet 35 (FIG. 7) once in a compression stroke of the engine, to lift the tappet 35 a distance corresponding to the decompression stroke l and open the valve and decompress a combustion chamber. A force exerted by the tappet on the cam portion 26, when the former is in abutting engagement with the latter, mainly derives from a valve spring of the tappet and is oriented toward the center axis of the camshaft and transmitted to the stopper pin 21 in the second recess 32 of the second centrifugal weight 25.

As the engine speed reaches the actual operation range, the centrifugal force produced by the second centrifugal weight 25 overcomes the biasing force of the spring 29 and the weight 25 pivotally moves in the direction of an arrow C about the pin 24 in FIG. 4, so that the minor diameter portion 21*a* of the pin 21 is brought out of engagement in the recess 32 and brought into abutting engagement with the projection 31. At the same time, the first centrifugal weight 22 pivotally moves in the direction of an arrow D in FIG. 4 about the pin 20, and the projection 31 of the second centrifugal weight 25 is pressed radially outwardly to bring the recess 33 into engagement with the minor diameter portion 21*a* (FIG. 4). While the weights 22 and 25 are in these positions, the cam portion 26 moves to a position inside the base surface 15*a* of the cam 15 in which it is prevented from being brought into abutting engagement with the tappet even if the camshaft 13 rotates.

Immediately before the engine stops, the biasing force of the spring 29 brings the increased thickness portion 30 into engagement with the stopper pin 21, to move the second centrifugal weight 25 in a direction opposite the direction of arrow C to its position shown in FIG. 4.

Figure 12:
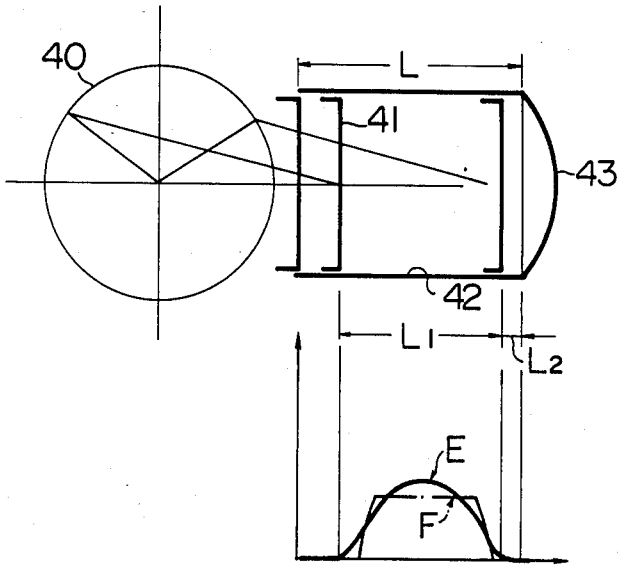
FIG. 12 is a diagrammatic representation of the relation between the crank angle and the movement of the valve operation member.

FIG. 12 is a graph in which the abscissa represents the crank angle and the ordinates indicates the lift of the tappet, and shows in a schematic view the condition of the operation of the decompression device corresponding to the relation between the lift and crank angle shown in the graph. It will be seen that as a crank pin rotates along an operation circle 40, a piston 41 moves in reciprocatory movement in a cylinder 42 constituting a combustion chamber 43. L is the total stroke in the compression step, and $L_1$ is the operation range of the decompression device. Thus, in this case, actual compression stroke is only $L_2$. The structural feature that the cam portion 26 is of pillar shape renders the relation between the crank angle and the lift of the tappet substantially in the form of a sine wave as represented by a solid line E.

In working the invention, the holder 16 may be connected to the camshaft 13 as by threadable connection. Alternatively, it may be fitted over the camshaft 13 and secured thereto as in the prior art.

The invention may be also applied to a motorcycle engine of a type in which the cams 14 and 15 are positioned against rocker arms which are connected to the valves, or to any other engine than motorcycle engines, such as an engine of a snowmobile.

From the foregoing description, it will be appreciated that the invention provides the features that the second centrifugal weight 25 is formed with the cam portion 26 and maintained in engagement with the holder 16 before engine startup. This is conducive to a reduction in the load caused on the first pin 20, resulting in little change in the lift of the tappet even if the parts become wobbly. The cam portion 26 may be in the form of a round claw. This renders the relation between the crank angle and the lift of the valve operating member substantially in the form of sine wave as indicated by the solid line E in FIG. 12, thereby making it possible for the members associated with the decompression of the combustion chamber 43 to operate smoothly. If the cam portion were in the form of a square claw as is the case with the prior art, the relation between the crank angle and the lift of the valve operating member would be stepped as represented by phantom lines F in FIG. 12, and the valve operating member would suffer the disadvantage of being abruptly actuated. Meanwhile, the arrangement whereby the holder 16 is connected to one end of the camshaft as shown in FIG. 3 enables the diameter of the holder 16 to be reduced. Moreover, it is possible to reduce the spacing between the two bearings 11 and 12, with a result that a bending moment caused in the camshaft can be reduced and the diameter of camshaft can be reduced. As shown in FIG. 3, the two centrifugal weights 22 and 25 are partially overlapping each other, thereby making it possible to obtain an overall compact size in a decompression device.

Having described a specific embodiment of our bearing, it is believed obvious that modification and variation of our invention is possible in light of the above teachings.

What is claimed is:

1. A decompression device for an internal combustion engine comprising:

a holder secured to a camshaft supporting cams for controlling suction and exhaust valves of the engine, said cams having a contour and said holder having secured thereto a first cylindrical pin and a stopper pin;

engine speed-responsive means including a first centrifugal weight supported by said holder for pivotal movement about said first pin and a second centrifugal weight supported on said first centrifugal weight for pivotal movement about a second pin having an axis parallel to said camshaft, said second centrifugal weight having a first recess and a second recess disposed in positions substantially symmetrical with the second pin with respect to the center axis of the camshaft for engagement with said stopper pin;

cam means including a cylindrical pillar disposed on said second weight radially inwardly of said second pin and extending axially of the camshaft toward the cams for engagement with a valve operating member associated with one of the cams; and tension spring means mounted between said first centrifugal weight and said second centrifugal for moving said weights between a first position wherein at high engine speeds when said first and second centrifugal weights are displaced by centrifugal forces said second recess of the second centrifugal weight engages the stopper pin and the cylindrical pillar of said cam means is disposed radially within the contour of one of said cams to disengage from said associated valve operating member and permit normal engine operation and a second position wherein at low engine speeds or when the engine is stopped said first recess of said second cylindrical weight engages the stopper pin and the cylindrical pillar of said cam means is disposed radially outside of the contour of said one of the cams to engage and lift said associated valve operating member to a decompression position.

2. A decompression device according to claim 1 wherein said holder has a cylindrical shape adapted to be press fit in an axial bore in an overhanging portion of the camshaft to secure the holder thereto.

3. A decompression device according to claim 1 wherein the pivotal movement of the first and second centrifugal weights of said engine speed-responsive means is rotational about said first and second pins, respectively, and radial relative to said camshaft, and said tension spring means opposes radial movement of said weights outwardly relative to said cam shaft when the engine speed has risen.

4. A decompression device according to claim 1 wherein said cam means relates the crank angle and the lift of the valve member substantially in the form of a sine wave as represented substantially by the curve E in FIG. 12.

* * * * *